United States Patent [19]

Muller, Jr.

[11] Patent Number: 4,840,016

[45] Date of Patent: Jun. 20, 1989

[54] PAPER BAG FEEDER FOR BAG-FILLING OPERATIONS AND PROCESS

[75] Inventor: John E. Muller, Jr., Yakima, Wash.

[73] Assignee: Pomona Service & Supply Co., Inc., Yakima, Wash.

[21] Appl. No.: 171,202

[22] Filed: Mar. 17, 1988

Related U.S. Application Data

[63] Continuation of Ser. No. 58,593, May 20, 1987, abandoned, which is a continuation of Ser. No. 729,506, May 2, 1985, abandoned.

[51] Int. Cl.[4] ..... B65B 43/30; B65B 43/18; B65B 39/10

[52] U.S. Cl. ..... 53/459; 53/573; 53/386

[58] Field of Search ..... 53/456, 459, 469, 386, 53/384, 570, 571, 573

[56] References Cited

U.S. PATENT DOCUMENTS

| | | | |
|---|---|---|---|
| 2,950,589 | 8/1960 | Litchard | 53/190 |
| 3,427,780 | 2/1969 | Bock | 53/573 |
| 3,619,981 | 11/1971 | Burke et al. | 53/573 |
| 3,750,365 | 8/1973 | Darby et al. | 53/573 |
| 3,789,573 | 2/1974 | Crabb | 53/55 |
| 3,830,038 | 8/1974 | Propst | 53/573 |
| 3,844,092 | 10/1974 | Stringer et al. | 53/571 |
| 3,884,278 | 5/1975 | Nakashima | 53/571 |

FOREIGN PATENT DOCUMENTS

| | | | |
|---|---|---|---|
| 647146 | 8/1962 | Canada | 53/571 |

*Primary Examiner*—Horace M. Culver

*Attorney, Agent, or Firm*—Robert W. Beach; Ward Brown

[57] ABSTRACT

Bags are fed individually along a linear path from an upright bag pack by front vacuum cups and after the leading bag has been separated from the pack, rear suction cups are engaged with the back of the leading bag. The front and rear suction cups are moved away from each other to enable a bag gripper to be inserted in its upper end after which the front suction cups are swung out of the bag path, the gripper is moved to move the leading bag past the front suction cups, the front suction cups are then swung back into the bag path, the rear suction cups are swung out of the bag path and the front suction cups are moved toward the bag pack to extract the next bag from the bag pack.

5 Claims, 10 Drawing Sheets

PAPER BAG FEEDER FOR BAG-FILLING OPERATIONS AND PROCESS

This is a continuation of co-pending application Ser. No. 058,593 filed on May 26, 1987 abandoned, which is an FWC continuation application of Ser. No. 729,506, filed May 2, 1985, now abandoned.

BACKGROUND OF THE INVENTION

1. Field of the Invention

The present invention relates to mechanism for automatically separating a bag from a pack and opening its mouth, such bag thereafter being picked up and moved manually or automatically to a filler.

2. Prior Art

The bag-feeding components shown in Litchard U.S. Pat. No. 2,950,589, issued Aug. 30, 1960, and Crabb U.S. Pat. No. 3,789,573, issued Feb. 5, 1974, are representative of known bag-feeding components in which suction is used to assist in separating a bag from a pack. Such components are used for feeding bags made of thin, flexible, imperforate, plastic sheet material, but are not effective for feeding bags of stiffer material such as tightly folded paper bags. Such paper bags are heavier and more resistant to opening and also are more textured so as to present special problems in obtaining a firm grip by use of a suction-applying member. Further, such paper bags are less resilient and more easily ripped if handled too roughly.

SUMMARY OF THE INVENTION

The principal object of the present invention is to provide mechanism for feeding bags of various types and materials to a bag holder which moves each bag to a filler.

An additional object is to provide such mechanism that can be used for quickly, automatically and reliably positioning bags to be picked up manually or by the holders of an automatic bagging machine.

In accordance with the above objects, it is an object to provide such mechanism that can be used for feeding bags of relatively stiff and/or textured materials, particularly known folded paper bags of the used for bagging produce.

These and other objects are accomplished by the paper bag feeder for bag-filling operations described in detail below.

DETAILED DESCRIPTION

A bag feeder in accordance with the present invention feeds bags from a pack consecutively so that they can be conveniently picked up for filling. While bags from the feeder can be picked up manually, it is primarily intended that the feeder of the present invention be used with an automatic bagging machine of which the type shown diagrammatically in FIG. 1 is representative.

Figure 1:
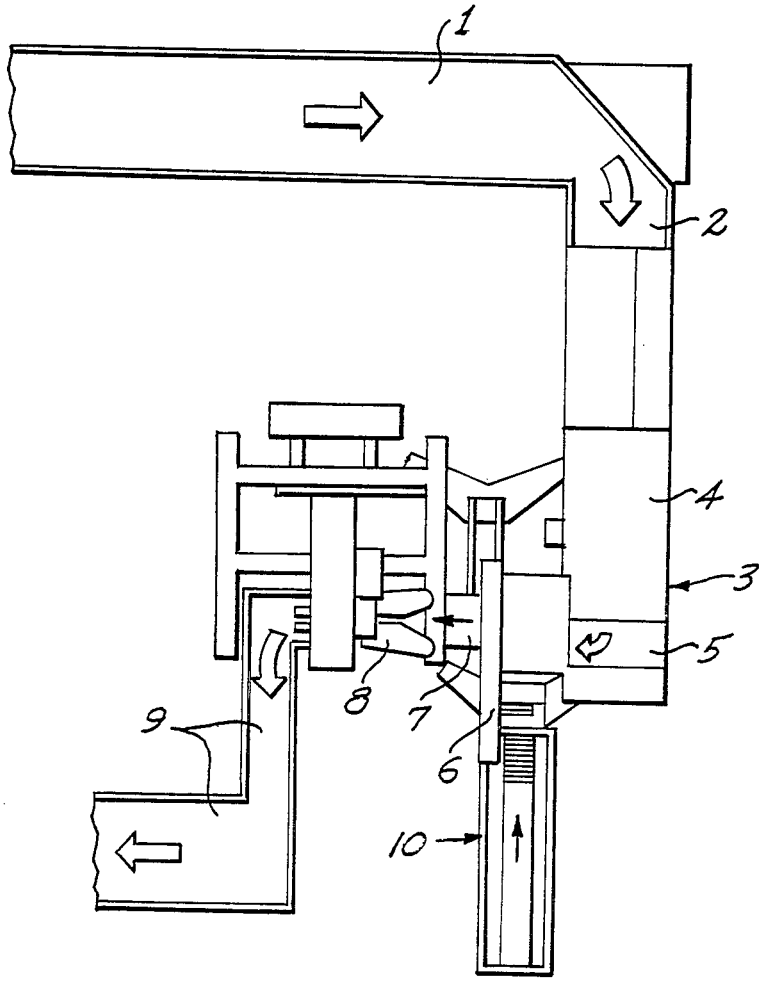
FIG. 1 is a very diagrammatic top plan of an automatic bagging machine having a bag feeder in accordance with the present invention.

The machine shown in FIG. 1 includes infeed conveyors 1 and 2 carrying articles to be bagged, such as produce, to an automatic weigher 3. Such weigher has a scales section 4 on which the articles are collected until the desired amount has been received, and an outfeed chute 5 by means of which the articles are discharged at the proper time into a bag held by bag pick-up, transfer and holding mechanism diagrammatically represented at 6. Such holding mechanism can include two downward-extending arms with hands or clamps for grasping and holding apart the lips of the bag mouth. After the bag is filled, the bag-holding mechanism releases the bag onto a transfer conveyor 7 which moves the bag to closing mechanism 8 which can be a stitcher for securely fastening the mouth of the bag is closed position. Discharge conveyors 9 move the bag away from the automatic bagging machine.

Figure 2:
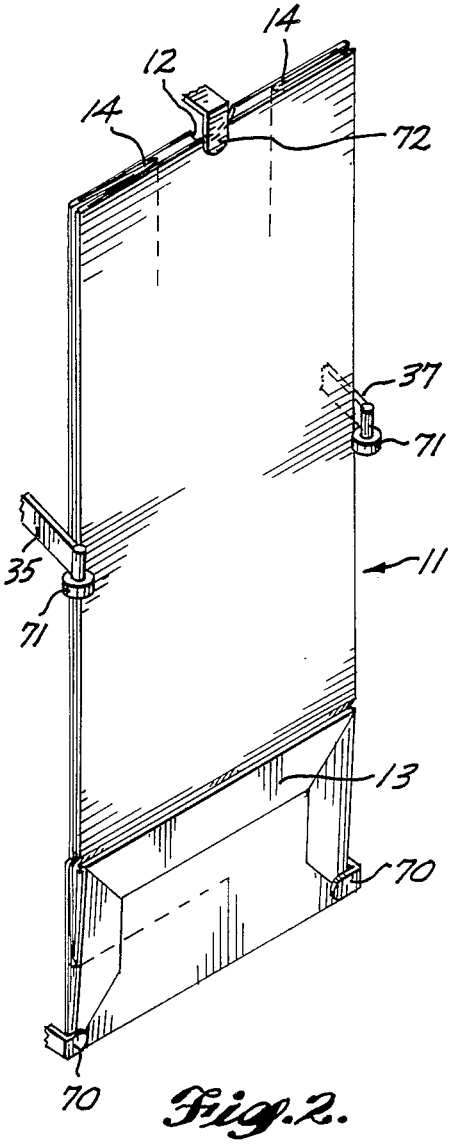
FIG. 2 is a top perspective of a folded paper bag that can be fed by a bag feeder in accordance with the present invention, and FIG. 3 a corresponding top perspective of such bag partially opened to illustrate its construction more clearly.
Figure 3:
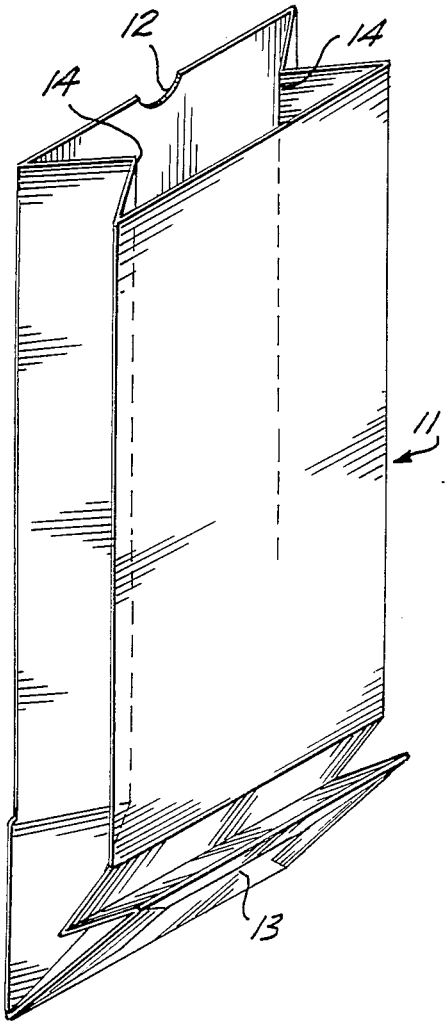

The present invention is concerned with the mechanism 10 for feeding the bags to the pick-up, transfer and holding mechanism 6 and is particularly useful for feeding folded paper bags of the type shown in FIGS. 2 and 3. Up to now, no effective bag-feeding mechanism has been provided for such paper bags which may be used for potatoes, for example.

The bag 11 shown in FIGS. 2 and 3 is formed of heavy paper sheet material which can be of double-ply construction. Although heavier and stiffer, bag 11 is similar to a common paper grocery bag in that bag 11 is openable from the flat, tightly folded condition shown in FIG. 2 to a generally rectangular condition with a flat bottom, front and back and substantially flat lateral sides. As seen in FIG. 3, a thumb notch 12 is usually provided in the upper margin of one face of the bag, namely, the face opposite the flat bag bottom 13 when such bottom is folded flat against the other bag face. Central crease 14 allow the opposite lateral sides of the bag to be folded inward between the uncreased faces. Such bags are supplied in packs, each bag being in the tightly folded condition shown in FIG. 2 with a substantially planar front (toward the viewer) and back (away from the viewer).

Figure 4:
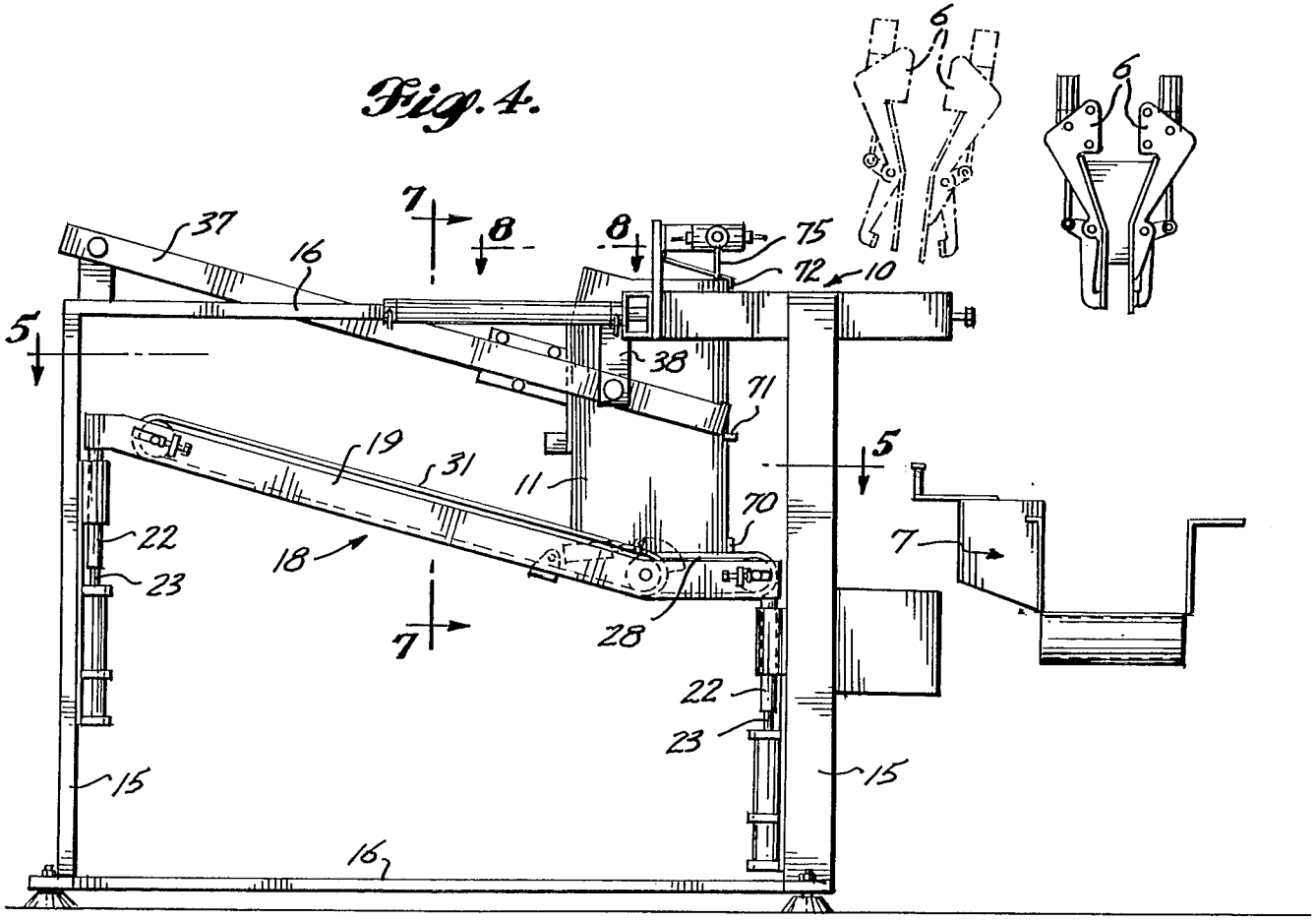
FIG. 4 is a somewhat diagrammatic side elevation of a bag feeder is accordance with the present invention.

With reference to FIG. 4, the bag feeder 10 in accordance with the present invention preferably is supported freestanding on a generally rectangular box frame having upright columns 15 at the four corners. Such columns are connected by longitudinally extending, horizontal, structural members 16 at the top and bottom and by suitable horizontal cross members 17 best seen in FIG. 5. As shown in FIG. 4, a pack of upright bags 11 is loaded in the feeder on a bag support and supply component 18. The leading portion of the feeder adjacent to the transfer conveyor 7 has mechanism for separating the leading bag from the pack and opening its mouth so that such bag can be picked up by the conventional pick-up mechanism or spades 6, such as the spades or holders shown in Crabb U.S. Pat. No. 3,789,573. From the broken line positions shown in FIG. 4, the spades are moved down and clamp the opposite lips. Then the spades are moved to the solid lines position where the bag is filled, whereupon the filled bag is released onto the transfer conveyor 7.

Figure 5:
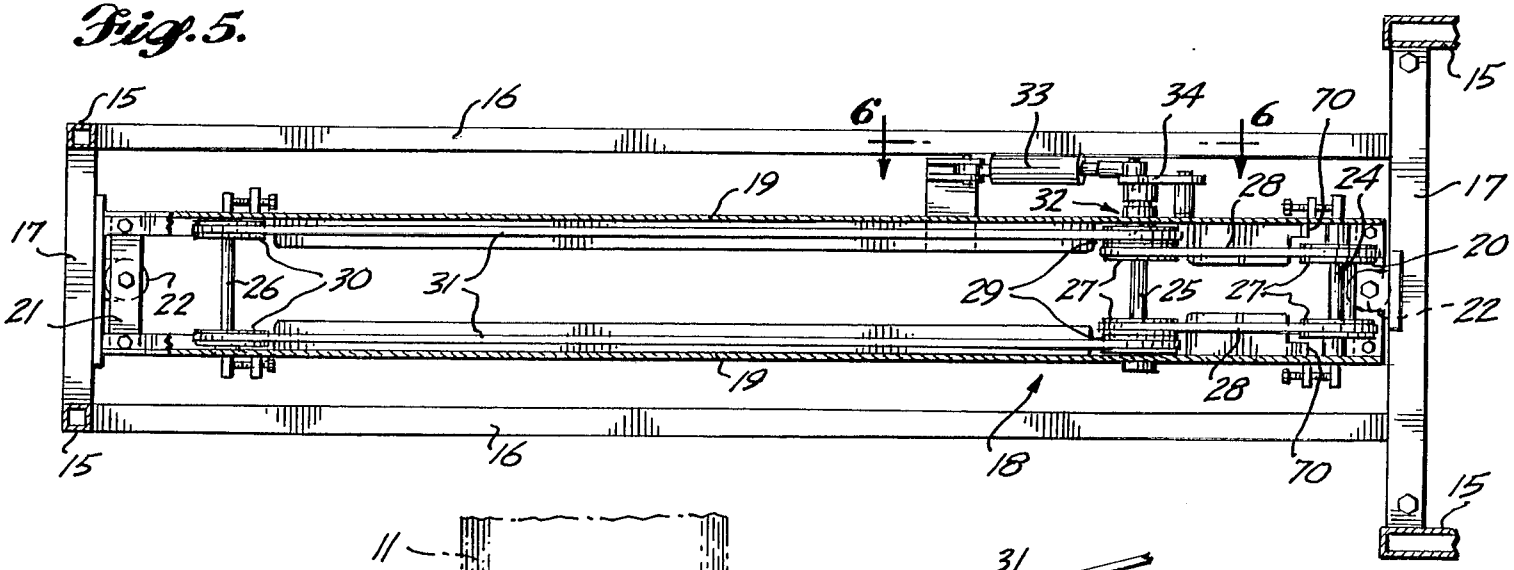
FIG. 5 is a horizontal section along line 5—5 of FIG. 4 with the bags removed, on a slightly larger scale and with parts broken away.

As shown in FIGS. 4 and 5, the bag support and supply component 18 includes longitudinally extending, laterally spaced, parallel rails 19 having their leading ends connected by a horizontal cross member 20 and their trailing ends connected by a horizontal cross member 21. The cross members 20 and 21 are carried at the upper ends of upright jacks 22 having plungers 23 extending downward and supported on the feeder frame.

As best seen in FIG. 5, rails 19 carry rotatable shafts 24, 25 and 26 each extending horizontally between the rails transversely of their lengths. Shafts 24 and 25 are positioned toward the front or leading ends of the rails. Shaft 26 is positioned toward the trailing or rear ends of the rails. Two pulleys 27 are fixed on each of shafts 24 and 25 adjacent to the rails 19, respectively. The pulleys on corresponding ends of the two shafts 24 and 25 are aligned for receiving endless V-belts 28 having horizontal bag-supporting upper runs. The intermediate shaft 25 also carries two additional pulleys 29 positioned outward of its pulleys 27. Such outer pulleys are aligned with corresponding pulleys 30 on the rear shaft 26. Long endless V-belts 31 extend around the pulleys 29 and 30 and have long bag-supporting upper runs inclined upward and rearward from the upper runs of the belts 28 as seen in FIG. 4.

Figure 6:
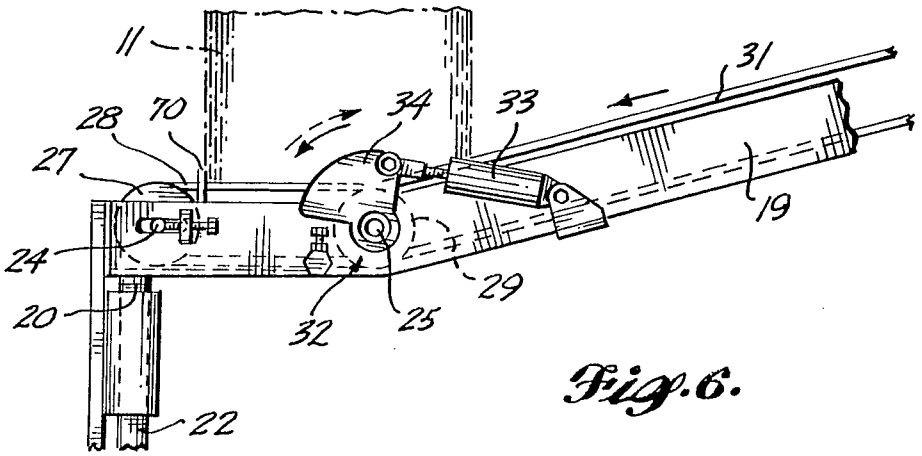
FIG. 6 is a fragmentary side elevation viewed from line 6—6 of FIG. 5, on a still larger scale.

The pack of loose bags 11 in upright position is fitted in the feeder 10 with the bottom edge of the bags resting on the upper runs of belts 28 and 31. During operation of the feeder, the bag pack is moved incrementally forward as each leading bag is separated, opened and picked up, which is accomplished by a one-way clutch or ratchet 32 best seen in FIG. 6. Such clutch or ratchet is driven by a fluid-operated jack or cylinder 33. Each extension of the jack plunger swings the operating level 34 to rotate shaft 25 counterclockwise as viewed in FIG. 6 sufficiently to move the pack forward a distance approximately equal to the thickness of a folded bag. The shaft is not rotated when the jack plunger retracts to move the lever to its starting position.

Figure 8:
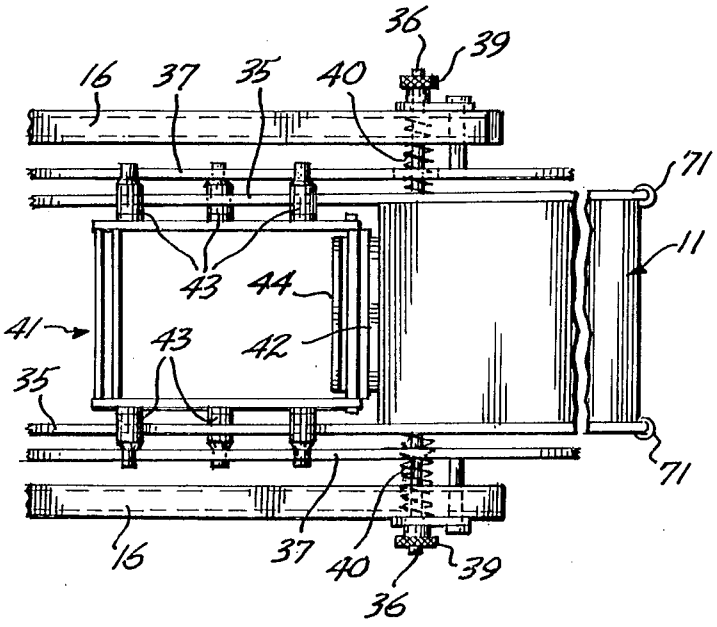
FIG. 8 is a fragmentary top plan viewed from line 8—8 of FIG. 4, with parts deleted and on the same scale as FIG. 7.
Figure 7:
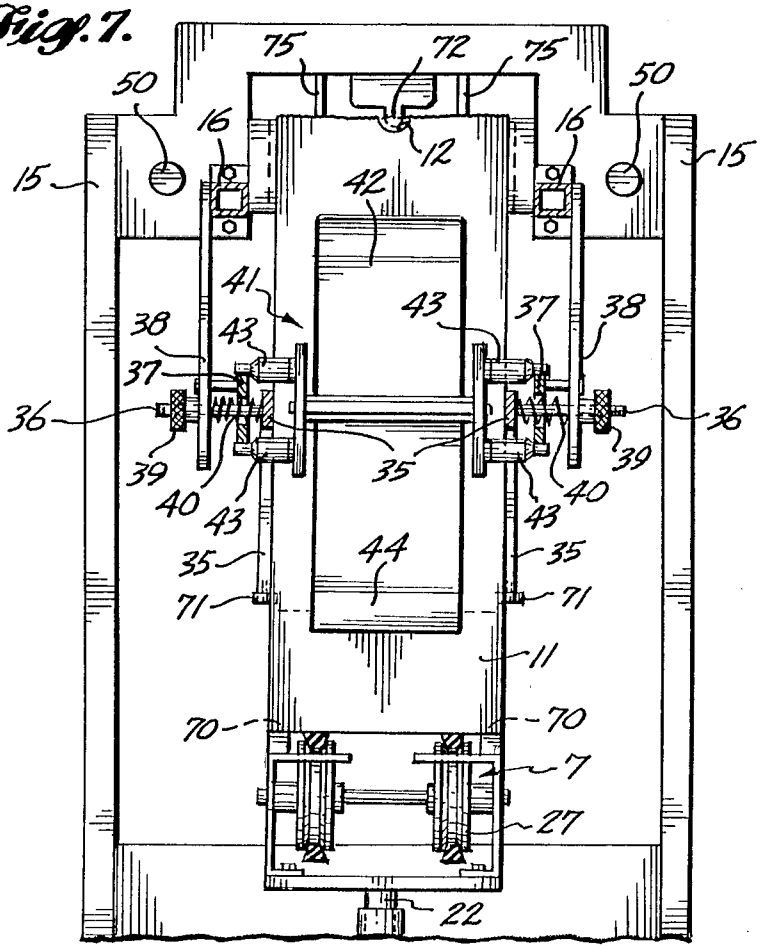
FIG. 7 is a vertical section along line 7—7 of FIG. 4, with parts deleted and parts broken away and on a still larger scale.

Preferably, each bag of the pack is maintained with its opposite upright edges in alignment with the edges of the other bags by adjustable rails 35 best seen in FIGS. 7 and 8. Such adjustable rails are carried on horizontal rods 36 extending outward through fixed rails 37 which, in turn, are rigidly supported from the longitudinal structural members 16 by upright plates 38. The outer end portions of the rods 36 project through holes in the plates 38 and have external threads for adjusting nuts 39.

Compression springs 40 encircling the shafts 36 extending loosely through holes in the fixed rails 37. The opposite ends of such springs bear against the facing surfaces of the adjustable rail 35 and the fixed rail support plates 38, so that the inner upright faces of the adjustable rails apply inward pressure to the opposite sides edges of the pack of bags approximately midway between the top and bottom of the pack. The amount of inward pressure applied and the positions of the adjustable rails 35 can be adjusted by turning the nuts 39. For example, the rails can be moved to accommodate packs of bags of different widths. In addition, to accommodate bags of different heights, the bottom bag-supporting rails 19 and the endless belts 28 and 31 can be adjusted up or down by the jacks 22 best seen in FIG. 4.

To maintain the bags in a tight pack, a carriage 41 carries an upright backing plate 42 engaged against the rear bag of the pack, as best seen in FIG. 7 and 8. Such carriage is supported on the inclined fixed rails 37 by rollers 43 and is biased downward by gravity to apply force to the back of the pack. Plate 42 is pivotally carried on the front of the carriage so that the leading face of the plate substantially contiguously engages the back of the trailing bag. A counterweight 44 carried at the bottom of the packing plate biases it to approximately a vertical position which simplifies loading a pack of bags in front of the plate.

It is very important that the leading face of the front bag be presented flat to the bag-separating and opening mechanism described below. This can be accomplished by providing several short stops engaging the margin of the front of the leading bag. As seen in FIG. 7, two short stops or flanges 70 project upward from rails 19 to engage the bottom corners of the leading bag. As seen in FIG. 8, the leading ends of the adjustable rails carry rollers 71 which project inward to engage the opposite side margins of the leading bag. Such rollers are positioned about midway between the top and bottom of the bag as seen in Figure 4. An additional stop is formed by central, fixed finger 72 engaging the top margin of the leading face of the front bag. The positions of the stops 70, 71 and 72 relative to the leading bag also are shown in FIG. 2. The combination of the stops 70, 71 and 72, the backing plate 42 being biased forward against the back of the trailing bag and the bags being supported upright on the incrementally moved conveyors results in the leading face of the leading bag being maintained substantially flat, particularly for the stiff, tightly folded paper bags with which the present invention is primarily concerned. Experimentation has established that it is particularly important that only a single central stop engage the upper margin of the leading bag, with the bags loaded so that their thumb notches force rearward.

With reference to FIGS. 9 through 12, mechanism is provided for separating the leading bag from the remainder of the pack, for opening the bag mouth and for maintaining the bag in position to be picked up manually or by the bag holders of an automatic bagging machine. As diagrammatically illustrated in FIG. 10, such opening mechanism includes top and bottom horizontal rods 45 and 46, respectively, rigidly mounted on the bag-feeder frame at each of its opposite sides. In addition to Figure 10, rods 45 and 46 can be seen clearly in FIGS. 11 and 12. Such rods extend through separate upright slides 47 and 48 moveable longitudinally along the rods. The horizontal plunger 49 of a fluid-operated cylinder 50 extends loosely through the rear slide 47 and is secured to the front slide 48. The rear slide 47 is biased forward, normally against the trailing side of the front slide 48, by a tension spring 51. Fixed to the rear slide 47 is a long sleeve 52 encircling the upper rod 45 and extending loosely through the front slide 48.

Figure 9:
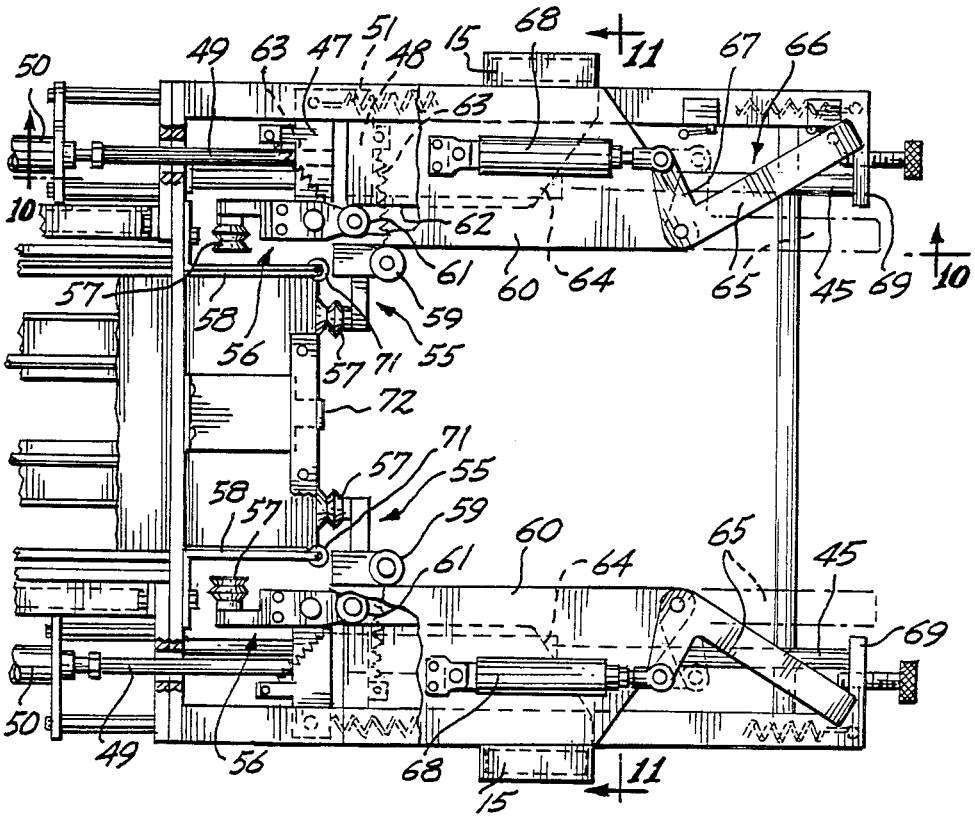
FIG. 9 is a fragmentary top plan of the leading or bag-opening portion of such feeder, with parts broken away.
Figure 10:
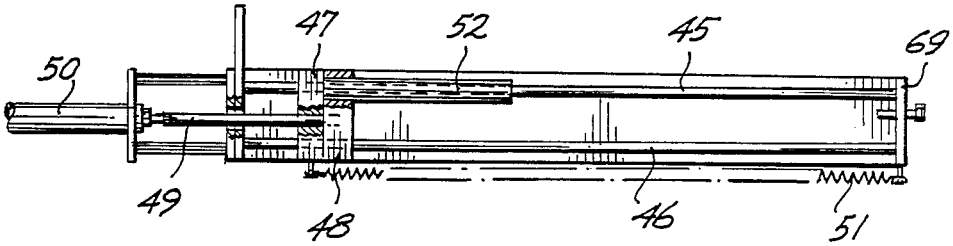
FIG. 10 is a diagrammatic vertical section along line 10—10 of FIG. 9, with parts deleted and on a slightly smaller scale.

With reference to FIG. 9, a front opening component 55 is mounted on the inner edge portion of each front slide 48 for swinging about an upright axis located alongside the path of the bags, and a rear opening component 56 is mounted on each rear slide 47 for swinging about an upright axis located alongside the path of the bags. Each opening component is in the form of a hollow block the interior of which communicates with the interior of top and bottom resilient suction cups 57 and a vacuum source (not shown). Flexible air hoses 73, seen in FIG. 11, extend between the vacuum source and each of the four suction cups of the two front opening components and the four suction cups of the two rear opening components.

In the position shown in FIG. 9 with the plungers 49 of jacks 50 retracted, the suction cups 57 of the front opening components 55 face rearward and are very closely adjacent to the leading face of the leading bag 11 at the upper corner portions of the bag. The rear opening components 56 are positioned alongside the opposite sides of the bag pack with their suction cups facing inward. Upright baffle plates 58 are provided at opposite sides of the bag pack between the rear opening component suction cups and the bags. The baffle plates prevent the leading bags from tilting sideways toward the suction cups of either of the rear opening components. Preferably the baffle plates are normally fixed, but are adjustable in and out to accommodate a bag pack of a different width.

Figure 11:
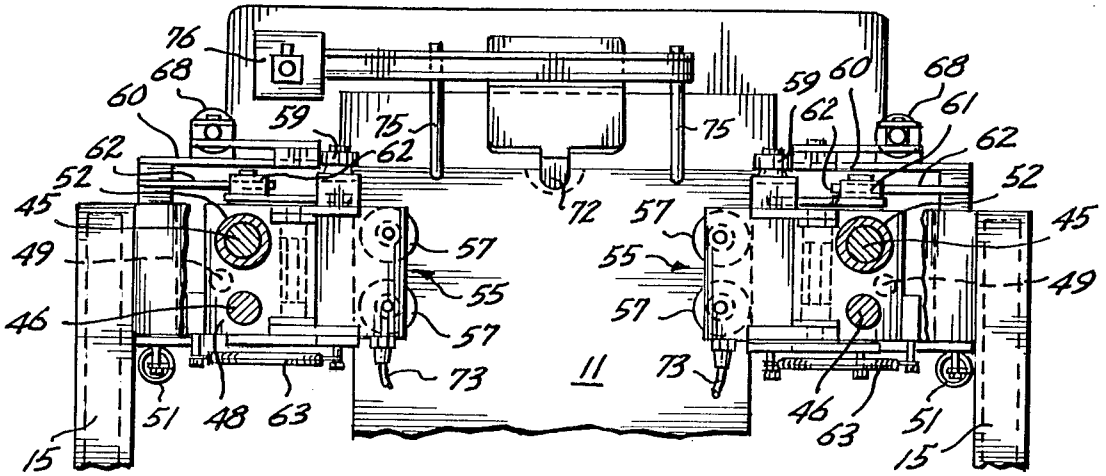
FIG. 11 is a vertical section along line 11—11 of FIG. 9, on a slightly larger scale, showing such bag-opening portion essentially in front elevation.
Figure 12:
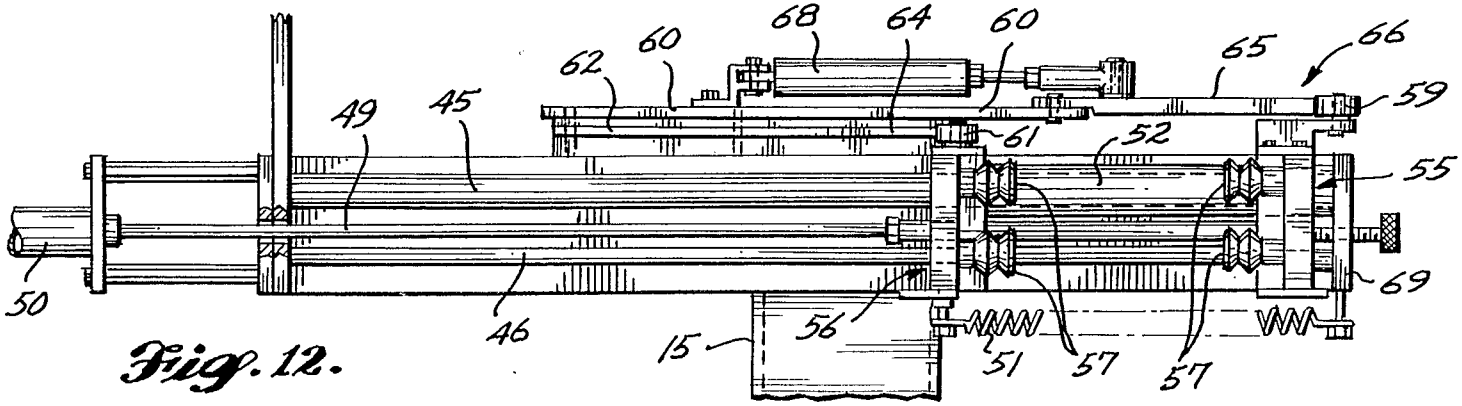
FIG. 12 is a fragmentary elevation of such bag-opening portion viewed from line 12—12 of FIG. 9, with parts in different positions and on a slightly larger scale than FIG. 9.

The front opening components 55 have cam follower rollers 59 engaged against the inner edges of horizontal, longitudinally extending cam plates 60 at opposite sides of the bag feeder. Similarly, the rear opening components 56 have cam follower rollers 61 engaged against the inner edges of longitudinally extending cam plates 62 located beneath the cam plates 60, as best seen in FIGS. 11 and 12. Returning to FIG. 9, both the cam follower rollers 59 of the front opening components 55 and the cam follower rollers 61 of the rear opening components 56 are biased to press against the edges of the cam plates 60 and 62, respectively by tension springs 63 connected between each opening component and its slide 47 or 48.

From the cam follower rollers 61 in the position shown in FIG. 9, each lower cam plate 62 has a first section of working edge extending linearly, longitudinally forward, and then a second section 64 angled abruptly outward. The entire working edge of cam plate 60 extends linearly and longitudinally of the feeder. An extension of such working edge is formed, however, by the inner upright edge of one leg 65 of a bell crank 66 pivoted on cam plate 60. Each leg 65 extends generally forward from its cam plate 60. The other leg 67 of the bell crank projects generally outward and can be swung fore-and-aft by a fluidoperated jack 68. In the position shown in FIG. 9, the inner working edge of bell crank leg 65 is angled forward and outward from cam plate 60 but, by extension of the plunger of jack 68, such leg can be swung inward to the broken-line position in which the inner edge of such leg is in continuation alignment with the inner edge of cam plate 60.

Operation of the bag-opening portion of the feeder is illustrated in FIGS. 9 and 10 and 13 through 16, FIG. 9 showing the starting positions for the various components. From the position of FIG. 9, the plungers of jacks 68 are extended to swing bell cranks 66 so that their forward-projecting legs 65 are in alignment with the edge of the top cam plate 60. The vacuum source is actuated so that suction is applied through all of the resilient suction cups 57 of the front opening components 55.

Figure 13:
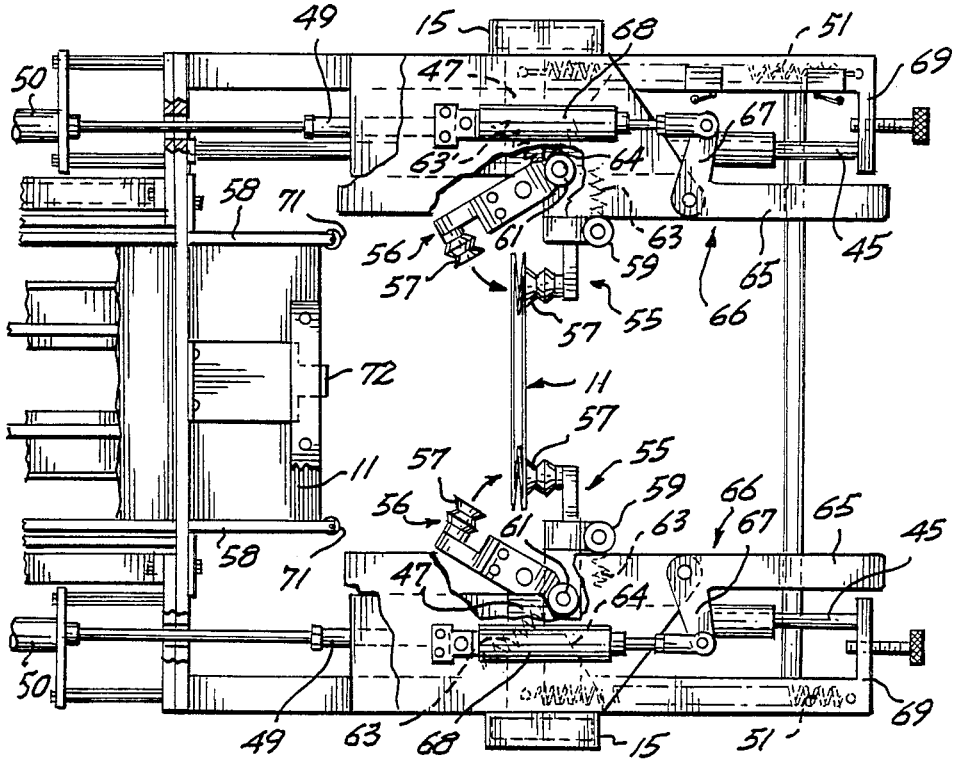
FIG. 13 is a fragmentary top plan of such bag-opening portion corresponding to FIG. 9, but with parts in different positions.

The upper corners of the leading face of the leading bag are gripped firmly by the upper and lower suction cups of 57 the front opening components 55. Plungers 49 of jacks 50 extend to move the front slides 48, and, consequently, the front opening components 55, forward. The rear slides 47 and their rear opening components 56 move forward with the front components by the action of the tension springs 51. As seen in FIG. 13, forward movement of the front opening components strips the leading bag 11 from the remainder of the pack which is held back by the stops 70, 71 and 72. The back face of the bag has the thumb notch through which the stop or finger 72 passes. The bag remains in tightly folded condition as it moves forward.

Forward outward swinging of the front bag components about upright axes at opposite sides of the bag path is prevented by engagement of their cam follower rollers 59 against the inner edges of the cam plate 60. Similarly, during the initial forward traveling movement of the rear opening components 56, engagement of their follower rollers 61 against the longitudinal inner edges of the lower cam plates 62 by the force of tension springs prevents forward and inward swinging of the rear opening components into the bag path about upright axes at opposite sides of the bag path. When cam follower rollers 61 reach the outward-inclined edge sections 64 of the cam plates 62, the rear opening components 56 are swung inward and forward about such as indicated in FIG. 13, by the action of the tension springs 63 connected between the rear slides 47 and the rear opening components. By such swinging of the rear opening components, the suction cups 57 of the rear opening components are moved into engagement with the upper corner portions of the back of the bag and suction produced by a vacuum source connected to such cups causes them to grip the bag securely.

Figure 14:
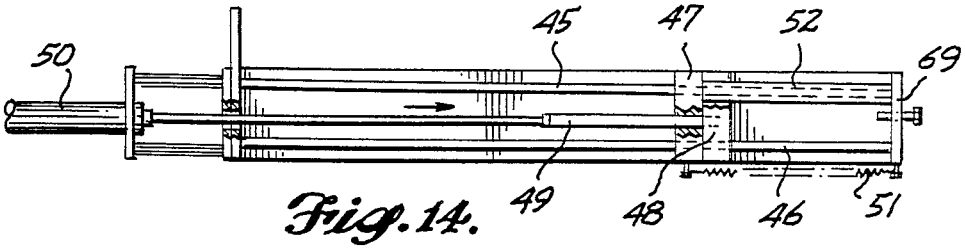
FIGS. 14 and 14a are diagrammatic vertical sections along line 14—14 of FIG. 13, corresponding to FIG. 10, with parts deleted and parts in different positions and on a slightly smaller scale than FIG. 13.
Figure 14A:
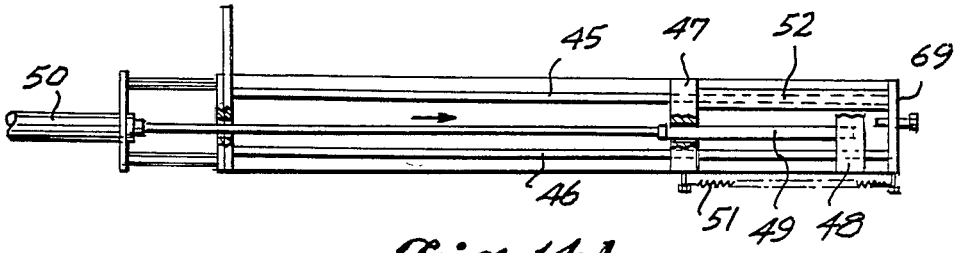
Figures 15, 16:
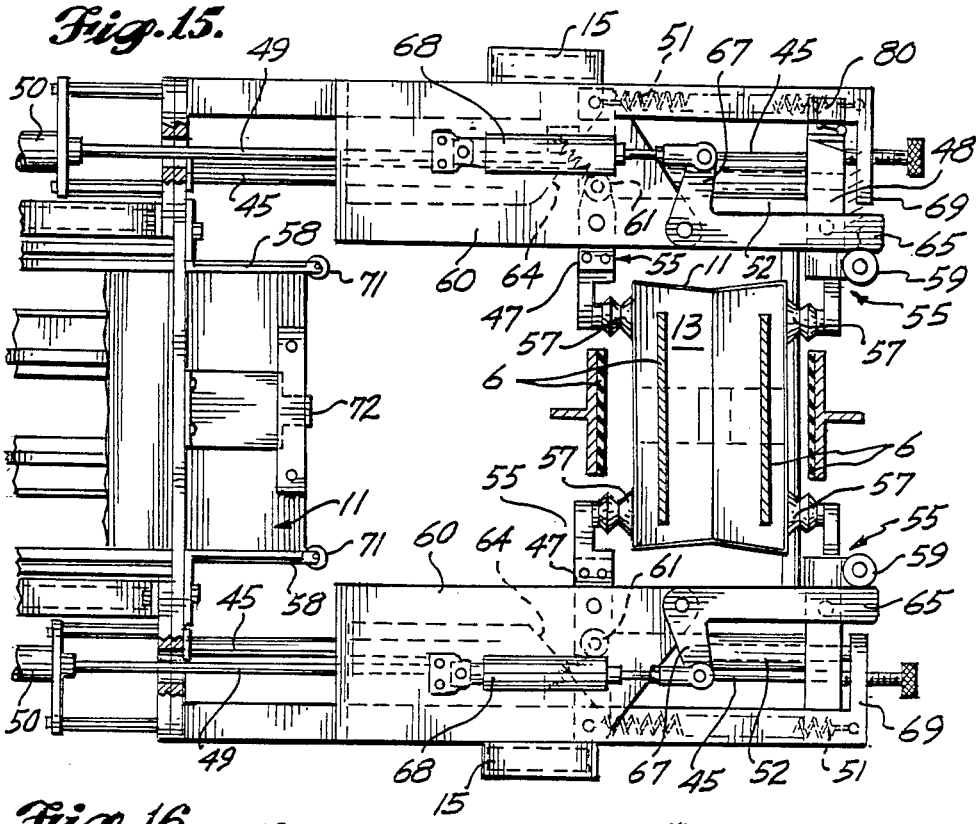
FIG. 15 and 16 are fragmentary top plans of such bag-opening portion corresponding to FIGS. 9 and 13, but with parts in different positions.

The opening components continue the forward translational movement together until the sleeves 52 projecting forward from the rear slides engage against the end plates 69 extending across the forward ends of the two slide rods 45 and 46, as seen in Figure 14. As seen in FIG. 14A, as the plunger 49 of jack 50 continues to extend, the front slides 48, and the front opening components, continue moving forward, whereas further movement of the rear slides 47 is arrested. Consequently, as seen in FIG. 15, the front and rear suction opening components are moved relatively apart for opening mouth of the bag as the top margin of the front face of the bag is drawn by the suction cups 57 of the front opening components 55 away from the top margin of the rear face of the bag held by the suction cups 57 of the rear opening components 56. In the bag-opened position shown in FIG. 15, the bag can be grasped manually, or the bag holders 6 of an automatic bagging machine can be inserted into the open bag mouth.

Once the bag has been grasped, as indicated in FIG. 16, the vacuum source to the suction cups 6 is turned off, thereby releasing the suction cups from the front and back faces of the bag. The plungers of jacks 68 are then retracted so that the forward-projecting bell crank legs 65 swing outward relative to the edge of cam plate 60 to the position shown in FIG. 16, which results in the front opening components 55 being swung outward away from the bag path about upright axes at opposite sides of the bag path by the force of springs 63. The bag can then be moved by the bag holder 6 away from the bag pack without obstruction by the front opening components 55.

To complete the cycle of operation of the feeder, the plungers 49 of jacks 50 are retracted, moving the front slide blocks 48 and the front opening components 55 inward and rearward. Such front opening components are swung inward about upright axes at opposite sides of the bag path by their follower rollers 59 rolling along the working surfaces of the outwardly inclined bell crank legs 65 to the edges of cams 60. Similarly, the rear opening components are swung rearward and outward about upright axes at opposite sides of the bag path by engagement of their follower rollers 61 with the working edges 64 of the lower cam plates 62 as the rear opening components are pulled rearward with the front opening components. The rear opening components are moved back behind the upright baffle plates 58 to the position indicated in FIG. 9.

Before the next bag-opening operation, the jack 33 controlling the incremental movement of the bag-supporting belts 28 and 31 is extended and then retracted thereby shifting the bag pack forward a distance approximately equal to the thickness of a tightly folded bag. The vacuum source is again actuated so that suction is applied through the opening component suction cups. To assure that the upper margin of the leading bag is firmly pressed against the suction cups of the front opening components, resilient rifflerfingers 75 are swiped across the tops of the several bags at the front of the bag pack. With reference to FIG. 11, the fingers 75 are swung by a conventional rotary actuator 76 from a horizontal, rearward-extending position approximately 90 degrees to the downward-extending position indicated in FIG. 11 and in FIG. 4. During such movement the free ends of the fingers engage the margins of the leading bag closely adjacent to the suction cups of the front opening components and assure that the upper corner portions of the leading bag engage against the suction cups. The positive action of pressing the leading bag forward is particularly important for packs that are dented or folded along their upper margins, such as from mishandling during transport.

Figure 17:
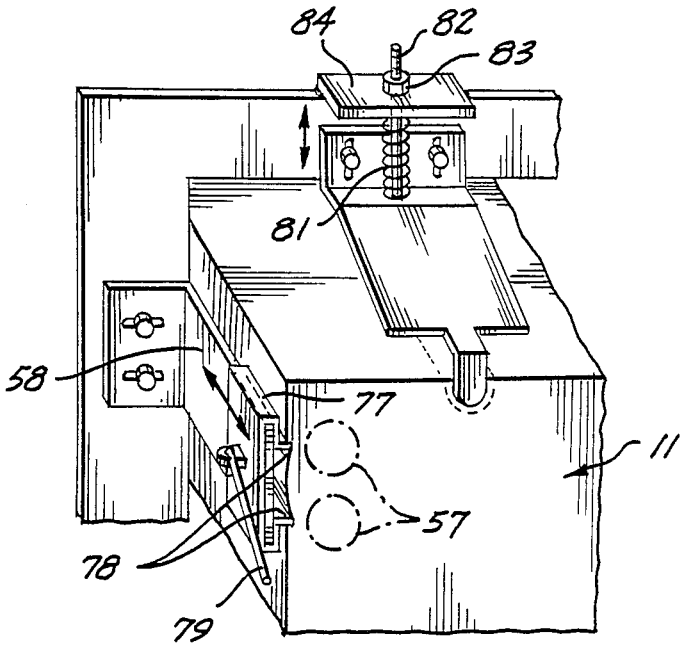
FIG. 17 is a fragmentary top perspective of the leading or bag-opening portion of a modified feeder in accordance with the present invention, with parts deleted.

An alternative mechanism for pressing the leading bag forward against the suction cups of the front opening components is shown in FIG. 17. A slide 77 is mounted on each baffle plate 58 for longitudinal movement and has inward-projecting teeth or dogs 78. The leading edge of each tooth 78 extends perpendicularly inward from its baffle plate, and the inner edge of each tooth is angled rearward and outward toward its plate. Preferably one tooth is located to engage the margin of the pack of bags 11 closely adjacent to each suction cup 57 of the front opening components.

Movement of each slide 77 can be controlled by a tie rod 79 having one end connected to the slide and the other end moved by an appropriate actuator. For example, movement of the tie rod can be coordinated with swinging of the bell cranks which are swung at the beginning of a bag-separating cycle. During forward movement of the slides, the leading edges of the teeth 78 riffle the side margins of the leading bags and press the leading bag against the suction cups of the front opening component. After the leading bag has been moved away from the remainder of the pack, such as when the bell cranks are swung to the position shown in FIG. 16, the slides are moved rearward and the angled inner edges of the teeth slide along the upright side edges of the remaining bags.

FIG. 17 also illustrates an alternative mounting for the stop or finger 72 which engages the top margin of the front face of the leading bag. Such finger projects down from a plate carried by a rod 82 extending upward through a mounting flange 84 fixed to the feeder frame. The upper end of rod 82 has threads for an adjusting nut 83. A compression spring 81 encircling rod 28 biases finger 72 down, and the adjusting nut can be turned to change the vertical position of the finger, such as to adjust for slight variations in the heights of different packs of bags.

Sequential control of the various cylinders is simplified if all cylinders are air actuated. Switches can be provided to coordinate operation of the feeder with operation of the remainder of an automatic bagging machine. For example, switch 80 shown at the upper right of FIGS. 15 and 16 is tripped when one of the front slide blocks 48 has reached its most forward position, indicating that a bag is ready to be picked up by the bagging machine holders 6. When the bag has been grasped by the holders, a single signal from the bagging machine can actuate the feeder to perform the next complete cycle of releasing the opened bag and separating and opening the next bag.

I claim:

1. Supply mechanism for feeding bags from a bag pack comprising means for supporting the bag pack with the bags upright and in face-to-face contact, two front suction cup means for gripping the front face of the leading bag at horizontally spaced locations, means for moving said front suction cup means away from the bag pack while said front suction cup means are applying suction to the front face of the leading bag for separating the leading bag from the bag pack and moving such bag along a linear bag path, two rear suction cup means for gripping the rear face of the leading bag at horizontally spaced locations, means supporting said rear suction cup means, respectively, for swinging about upright axes at opposite sides of the bag path toward each other from positions at opposite sides of the bag path into horizontally spaced locations in the bag path behind the leading bag separated from the bag pack by said front suction cup means for engagement with the rear face of the leading bag, means for applying suction to said front suction cup means and to said rear suction cup means for gripping the front face and the rear face, respectively, of the leading bag separated from the bag pack, means for moving said front suction cup means and said rear suction cup means relatively apart for opening such leading bag, means mounting said two front suction cup means for swinging about upright axes at opposite sides of the bag path, respectively, and thereby withdrawing said front suction cup means away from the front face of the leading bag out of the bag path, means for gripping the opened upper end of the leading bag and moving such opened bag farther away from the bag pack past said outwardly swung front suction cup means, means for swinging said two front suction cup means about their axes toward each other into the bag path, and means for swinging said two rear suction cup means about their axes away from each other out of the bag path.

2. The mechanism defined in claim 1, in which the bag pack supporting means includes a conveyor having a generally horizontally extending pack supporting run, means for maintaining the bag pack on said run with the bag faces upright and the bag bottom edges resting on said run and means for moving said conveyor run forward incrementally in coordination with separation of bags from the bag pack by action of the front suction-applying means.

3. The mechanism defined in claim 1, in which the bag pack supporting means includes a generally horizontally extending, elongated support member, a pair of elongated generally parallel rails extending longitudinally above and at opposite sides of said support member and spaced apart transversely for receiving the pack between said rails with the bottom edges of the bags resting on said support member and the opposite side edges of the bags adjacent, respectively, to said rails and means biasing said rails resiliently inward into engagement with the side edges of the bags for maintaining such edges in alignment.

4. The mechanism defined in claim 1, including a multiplicity of separate transversely and vertically spaced stops positioned for engaging the top, side and bottom margins of the front face of the front bag in the bag pack to maintain such face upright.

5. A process for feeding bags from a bag pack for filling which comprises supporting a bag pack with the bags upright and in face-to-face contact, engaging front suction cups with the front faces of the leading bag at horizontally spaced locations, while the front suction cups are applying suction to the front face of the leading bag moving the front suction cups away from the bag pack and thereby separating the leading bag from the bag pack and moving such bag along a linear bag path, swinging rear suction cups oppositely about upright axes at opposite sides of the bag path toward each other from positions at opposite sides of the bag path into horizontally spaced locations in the bag path behind the leading bag separated from the bag pack and engaging the rear suction cups with the rear face of the leading bag separated from the bag pack, applying suction to the front suction cups and to the rear suction cups for gripping the front face and the rear face, respectively, of the leading bag separated from the bag pack and moving the front suction cups and the rear suction cups relatively apart for opening such leading bag, inserting bag top grippers into the opened end of the leading bag and gripping such bag opened end with such grippers, discontinuing suction by the front suction cups, swinging the front suction cups oppositely away from each other about upright axes at opposite sides of the bag path and thereby withdrawing the front suction cups from the bag path away from the front face of the leading bag, discontinuing suction by the rear suction cups, translating the bag top grippers along the bag path away from the bag pack and thereby moving the bag gripped by the bag top grippers away from the rear suction cups and past the outwardly swung front suction cups, swinging the rear suction cups away from each other about upright axes at opposite sides of the bag path to locations out of the bag path, swinging the front suction cups toward each other about upright axes at opposite sides of the bag path into positions in the bag path, and moving the front suction cups along the bag path toward the bag pack and into contact with the front face of the next bag in the bag path preparatory to withdrawing such next bag from the bag path.

* * * * *